US011278791B2

(12) United States Patent
Chait

(10) Patent No.: US 11,278,791 B2
(45) Date of Patent: Mar. 22, 2022

(54) STACKING CUPS

(71) Applicant: Yochanan Chait, Jerusalem (IL)

(72) Inventor: Yochanan Chait, Jerusalem (IL)

( * ) Notice: Subject to any disclaimer, the term of this patent is extended or adjusted under 35 U.S.C. 154(b) by 0 days.

(21) Appl. No.: 16/644,513

(22) PCT Filed: Sep. 6, 2018

(86) PCT No.: PCT/IL2018/051015
§ 371 (c)(1),
(2) Date: Mar. 5, 2020

(87) PCT Pub. No.: WO2019/049153
PCT Pub. Date: Mar. 14, 2019

(65) Prior Publication Data

US 2020/0289917 A1 Sep. 17, 2020

Related U.S. Application Data

(60) Provisional application No. 62/555,361, filed on Sep. 7, 2017.

(51) Int. Cl.
*A63F 9/00* (2006.01)
*A63F 9/26* (2006.01)

(52) U.S. Cl.
CPC ..... *A63F 9/001* (2013.01); *A63F 9/0073* (2013.01); *A63F 9/26* (2013.01); *A63F 2009/0053* (2013.01)

(58) Field of Classification Search
CPC ..... A63F 9/001; A63F 9/0073; A63F 2009/0053; A63F 9/26; A63H 33/046; B65D 85/8046; B65D 21/023
See application file for complete search history.

(56) References Cited

U.S. PATENT DOCUMENTS 3,528,585 A * 9/1970 Kalmar ..... B65D 21/0235 206/509
4,057,931 A * 11/1977 Stutelberg ..... A01G 9/023 47/83
6,134,832 A 10/2000 Bokmiller et al.
6,520,366 B1 * 2/2003 Bradley ..... A47G 19/065 220/23.2
7,673,767 B2 * 3/2010 Vovan ..... B65D 21/0237 220/212

(Continued)

FOREIGN PATENT DOCUMENTS

DE 20 2010 009758 U1 10/2010
DE 202010009758 * 11/2010 ..... B65D 81/06

(Continued)

OTHER PUBLICATIONS

ISR; Commisioner for Patentsl Virginia; dated Jan. 16, 2019.

*Primary Examiner* — Michael D Dennis
(74) *Attorney, Agent, or Firm* — Patshegan IP LLC; Moshe Pinchas

(57) ABSTRACT

A stacking cup is provided including a side wall having a rim on a first end thereof defining an upper opening; a bottom portion defined on a second end of the side wall such that the sidewall and the bottom portion define a vessel having the upper opening; at least one engaging element defined on the bottom portion the engaging element being configured to engage a portion of a rim of another cup such that the other cup is securely held by the engaging element.

17 Claims, 6 Drawing Sheets

(56) References Cited

U.S. PATENT DOCUMENTS

| | | | | |
|---|---|---|---|---|
| 7,946,422 | B1 * | 5/2011 | Bjerke | B65D 43/162 206/546 |
| 9,010,759 | B2 | 4/2015 | McDonnell | |
| 2011/0220665 | A1 * | 9/2011 | McDonnell | B65D 21/0212 220/592.17 |
| 2013/0134677 | A1 | 5/2013 | McDonnell et al. | |
| 2014/0144804 | A1 * | 5/2014 | Roodnat | B65D 1/265 206/511 |
| 2017/0106272 | A1 * | 4/2017 | Heagerty | A63H 33/084 |
| 2018/0099231 | A1 * | 4/2018 | Schwartz | A63H 33/046 |

FOREIGN PATENT DOCUMENTS

| | | | |
|---|---|---|---|
| GB | 2475918 | A | 6/2011 |
| NL | 1026890 | C2 | 8/2006 |
| WO | 2012066303 | A1 | 5/2012 |

* cited by examiner

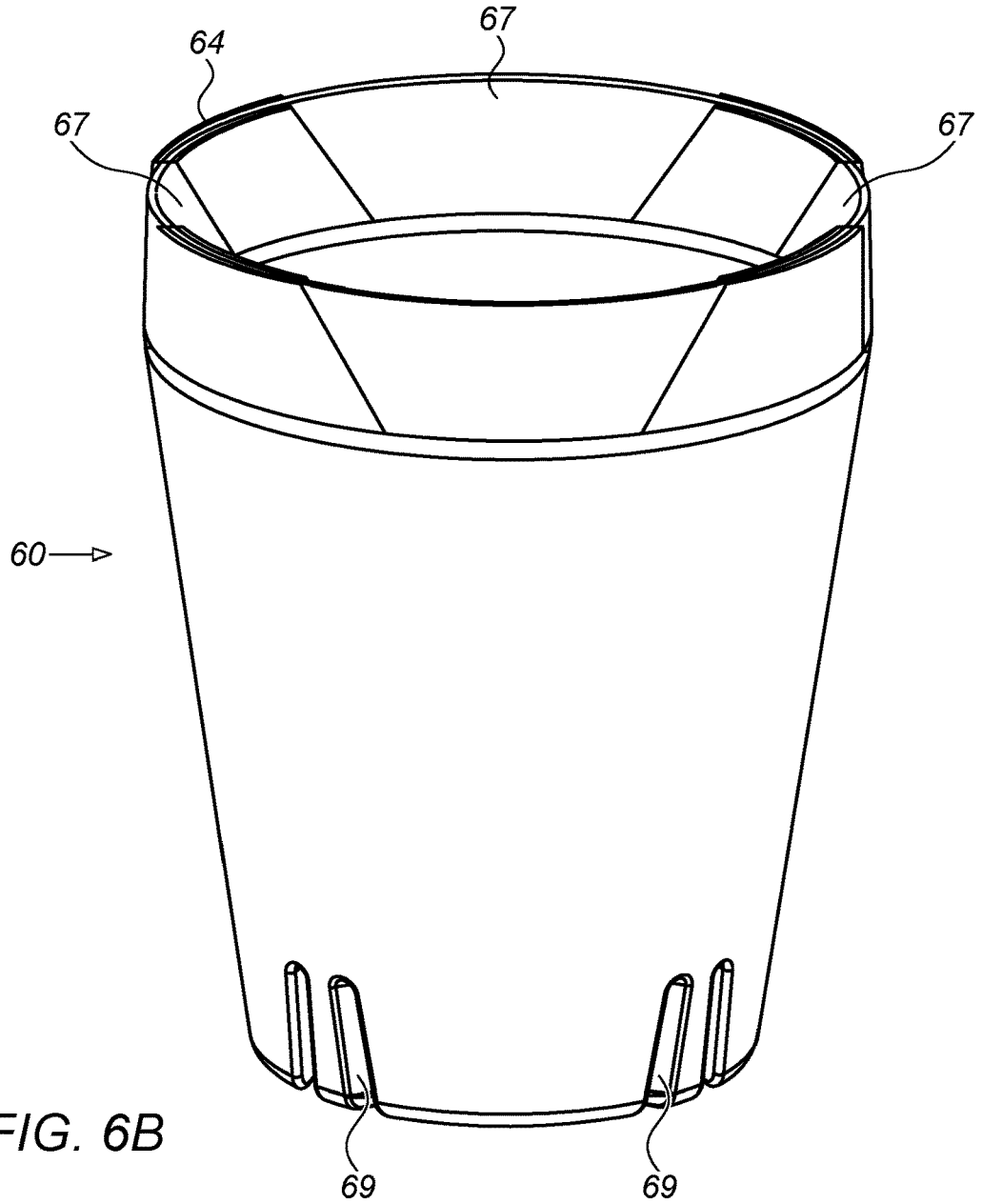
FIG. 6B
FIG. 7
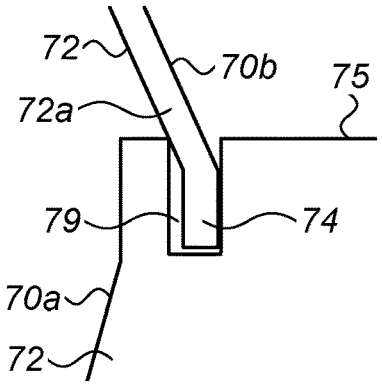

STACKING CUPS

FIELD OF INVENTION

The presently disclosed subject matter relates to a stacking cups in general and in particular to a stacking cups game for forming various shapes with the cups.

BACKGROUND

Stacking games are well known developmental tool for toddlers and facilitate enhancing motoric abilities, hand-eye coordination and other skills. Some recent researches also suggest that such games are also beneficial for developing mathematical abilities by exploring complex concepts in geometry such as balance and symmetry.

The use of cups as a stacking game is very common due to the symmetrical shape of the cups and since the cups are stackable inside one another facilitating storage thereof.

SUMMARY OF INVENTION

There is provided in accordance with an aspect of the presently disclosed subject matter a stacking cup including a side wall having a rim on a first end thereof defining an upper opening; a bottom portion defined on a second end of the side wall such that the sidewall and the bottom portion define a vessel having the upper opening; at least one engaging element defined on the bottom portion the engaging element being configured to engage a portion of a rim of another cup such that the other cup is securely held by the engaging element.

The at least one engaging element can include four engaging elements each being configured to securely hold a portion of a rim of one other cup, such that the bottom portion securely holds four other cups simultaneously.

The at least one engaging element can be a groove defined along a section of the bottom portion and being configured to allow insertion of the rim of the other cup such that the other cup is securely held therein.

The groove can be defined along a line extending inside the bottom portion between two points along the circumference of the bottom portion.

The line can be an arc having a radius corresponding to radius of the rim of the other cup. The arc can be an arc of a circle having a central axis which is different than a central axis of the bottom portion, such that a first portion of the rim of the other cup is held inside the groove while a second portion of the rim of the other cup is disposed sidelong the bottom portion. The first portion can be smaller than the second portion.

The least one engaging element can include four engaging elements each having a groove extending along an arc each of which have an orientation with respect to one of the sides of the sidewall, allowing thereby securing another cup to the bottom portion at four different orientations. The four orientations can be symmetrically defined with respect to a central axis of the bottom portion.

The sidewall can include a sloped portion extending with an angle with respect to the bottom portion and wherein the rim vertically extends with respect to the sloped portion. The width of the groove can be larger than the width of the rim, and depth of the groove can be larger than height of the rim, such that when the rim is inserted inside a groove of another cup, a portion of the sidewall is disposed inside the groove and is supported by the groove such that the other cup vertically extends with respect to the bottom portion.

The rim can include at least one guide for facilitating insertion of the rim into a groove of another cup. The guide can include a depression wherein width of the rim is larger than the width of the groove, the depression defines a section having a reduced width corresponding to the width of the groove such that insertion of a rim of another cup into the groove is carried out by inserting the depression into the groove.

The groove can extend along an arc having an orientation with respect to one of the sides of the sidewall, and wherein the depression is disposed along the rim with a corresponding orientation, such that when the other cup is held by the groove, groove of the other cup is oriented in a same orientation.

There is provided in accordance with an aspect of the presently disclosed subject matter a stacking game having at least one first cup and at least one second cup, each of the first and second cups having a side wall having a rim on a first end thereof defining an upper opening; a bottom portion defined on a second end of the side wall such that the sidewall and the bottom portion define a vessel having the upper opening; at least one engaging element defined on the bottom portion the engaging element of the first cup being configured to engage a portion of a rim of the second cup such that the second cup is securely held by the engaging element.

The at least one second cup can include four second cups and wherein the engaging element includes four engaging elements each being configured to securely hold a portion of a rim of one of aid second cups, such that the bottom portion securely holds the four second cups simultaneously.

The engaging elements can be grooves each defined along a section of the bottom portion and being configured to allow insertion of the rim of one of the second cups such that the second cup is securely held therein.

Each one of the grooves can be defined along a line extending inside the bottom portion between two points along the circumference of the bottom portion.

The line can be an arc having a radius corresponding to radius of the rim of the second cups.

The arc can be an arc of a circle having a central axis which is different than a central axis of the bottom portion, such that a first portion of the rim of the second cup is held inside the groove while a second portion of the rim of the second cup is disposed sidelong the bottom portion.

Bottom and top, as defined herein the description, refers to a cup oriented such that the opening of the cup is directed upwards, while the base of the cup is directed downwards. For the sake of the game, however, the cups can be disposed such that the bottom portion is directed upwards.

BRIEF DESCRIPTION OF THE DRAWINGS

In order to understand the disclosure and to see how it may be carried out in practice, embodiments will now be described, by way of non-limiting examples only, with reference to the accompanying drawings, in which:

FIG. 6B is a side perspective view of the cup of FIG. 6A; and

FIG. 7 is a side sectional view of a portion of cup according to another example of the presently disclosed subject matter having another cup engaged thereto.

DETAILED DESCRIPTION OF EMBODIMENTS

Figure 1:
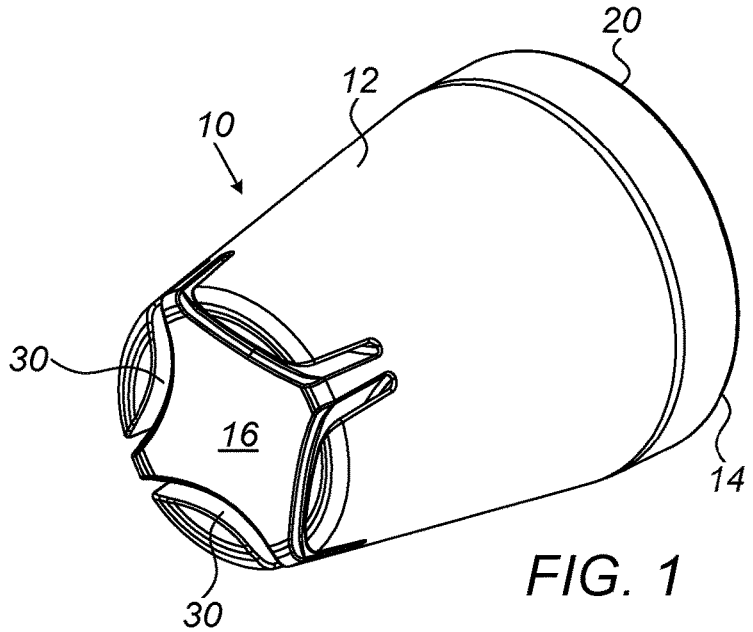
FIG. 1 is a side perspective view of a cup of a stacking cups game in accordance with an example of the presently disclosed subject matter.
Figure 2:
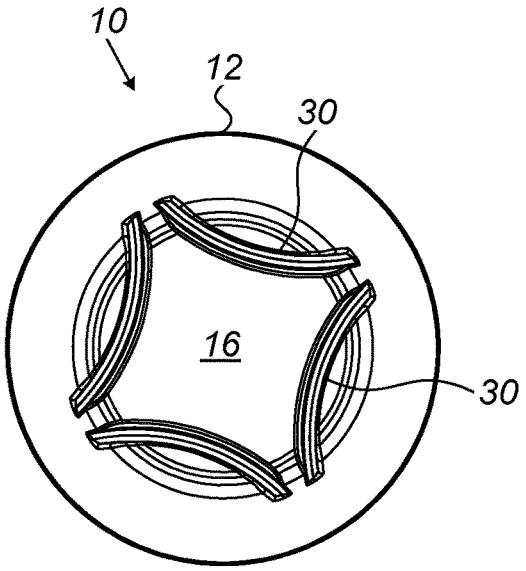
FIG. 2 is a bottom view of the cup of FIG. 1.

The presently disclosed subject matter provides a stacking cups game including a plurality of stackable and nestable cups configured for coupling to one another.

Reference is made to FIGS. 1 to 3A, a stacking cup 10 of the stacking cup game according to an example of the presently disclosed subject matter includes a side wall 12 having a rim 14 on a first end thereof defining an upper opening 20. The cup further includes a bottom portion 16 defined on a second end of the side wall 12 such that the sidewall and the bottom portion 16 define a vessel having an upper opening 20.

The stacking cup 10 further includes at least one engaging element, here illustrated as a groove 30, defined on the bottom portion 16. The engaging element 30 is configured to engage a portion of a rim 14 of another cup such that the other cup is securely held by the engaging element 30.

According to the illustrated example, the stacking cup 10 includes four engaging elements 30, each being configured to securely hold a portion of a rim of one other cup, such that the bottom portion 14 of the illustrated cup is configured to securely hold four other cups simultaneously.

According to an example, the groove 30 is defined along a section of the bottom portion 16 and is being configured to allow insertion of the rim of another cup such that the other cup is securely held therein. The groove 30 can be defined along a line extending inside the bottom portion 16 between two points along the circumference of the bottom portion 16. The line can thus be an arc having a radius corresponding to radius of the rim 14 of the other cup, such that the rim can be inserted inside the groove 30.

Figure 4:
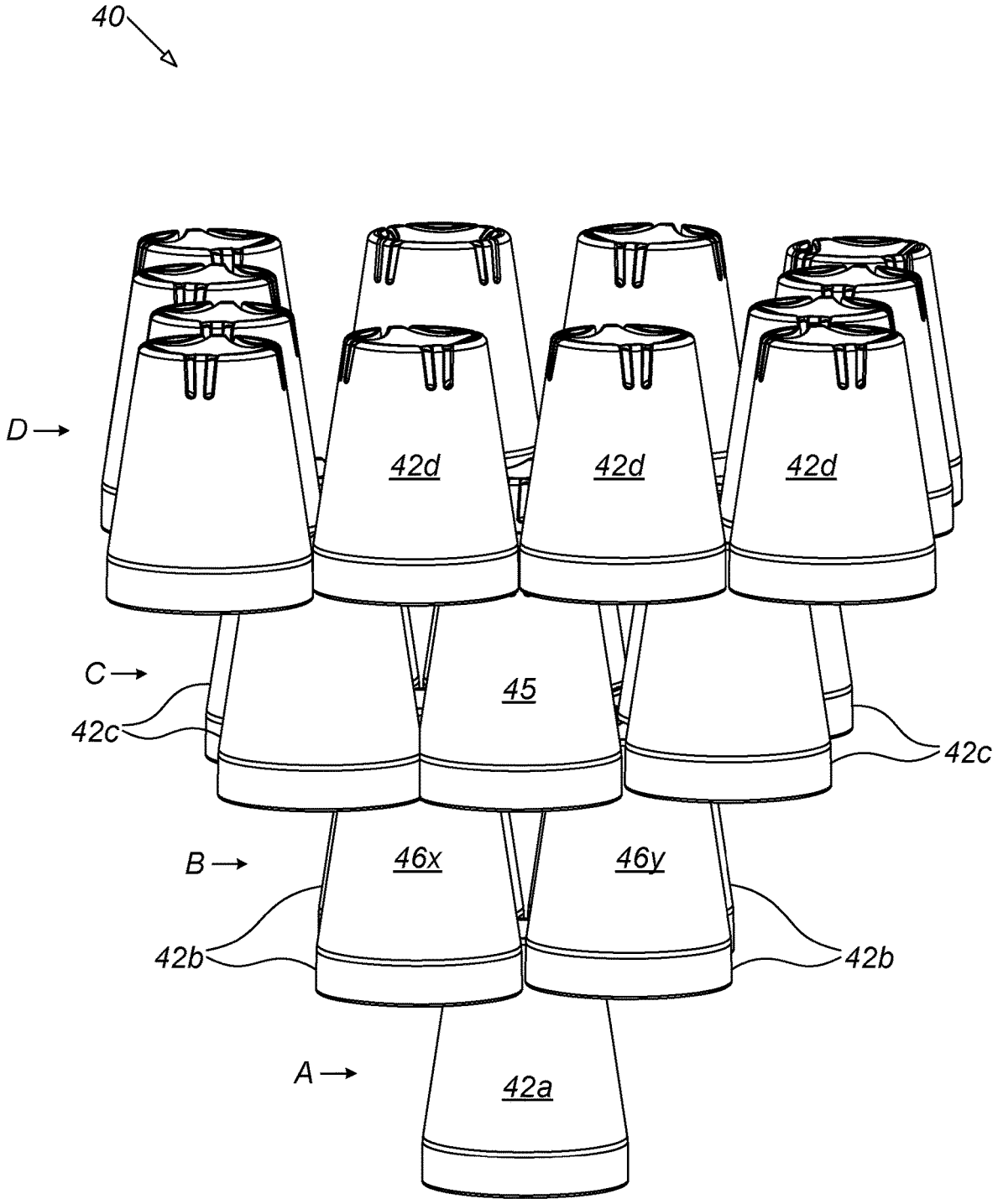
FIG. 4 is a side view of a plurality of cups stacked in an up-side-down position forming a shape of an up-side-down pyramid.
Figure 5:
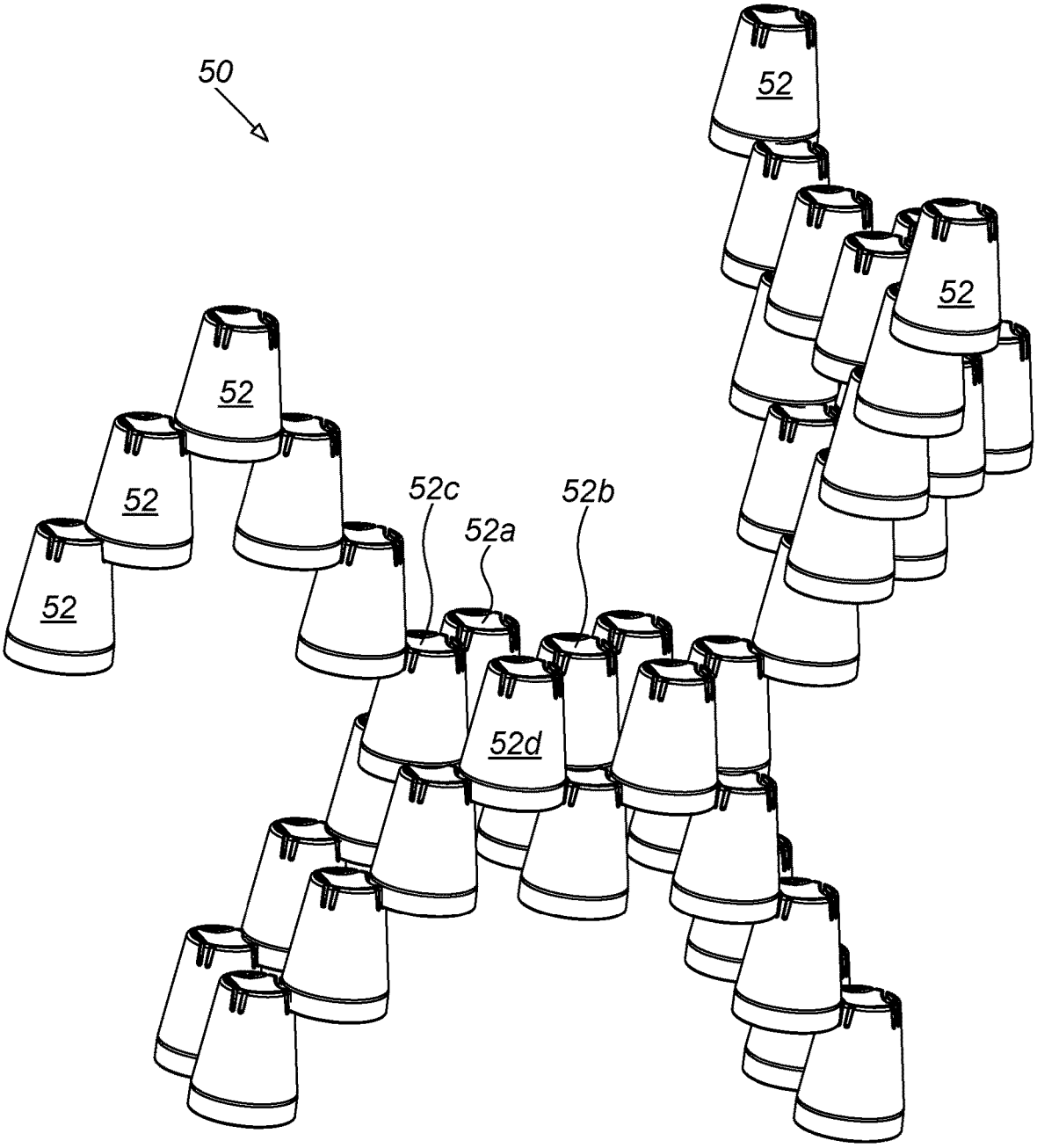
FIG. 5 is a side view of a plurality of cups stacked in an up-side-down position forming a shape of a dog.

As shown in the illustrated example, the groove 30 is an arc of a circle having a central axis which is different than a central axis of the bottom portion, such that a first portion of the rim 14 of the other cup is held inside the groove 30 while a second portion of the rim 14 of the other cup is disposed sidelong the bottom portion 16. I.e. the bottom portion of the first cup 10 holds only a portion of the rim 14 of the second cup, while the other portion of the rim is disposed outside the circumference of the bottom portion 16 of the first cup. This way, other portions of the circumference of the second cup can be disposed with nothing underneath. The groove 30 is thus configured to securely hold the rim 14 of the second cup such that no other mechanical support to the other cup is required. As shown in FIGS. 4 and 5 this feature allows stacking the cups in various forms and shapes.

It is appreciated that the length of the portion of the circumference of the rim 14 of the second cup which is held inside the groove of the first cup is determined in accordance with the mechanical strength required to support the second cup. According to an example, the first portion of the circumference of the rim 14 of the second cup, i.e. the portion which is held inside the groove of the first cup, is smaller than the second portion thereof, i.e. the portion which is disposed in outside the circumference of the bottom portion of the first cup.

According to the illustrated example, the bottom portion 16 of the stacking cup includes four engaging elements, for example four grooves each extending along an arc having an orientation with respect to one of the sides of the sidewall 12 of the cup. That is to say, each groove 30 is in a shape of an arc whose curvature is directed to one side of the cup. The arcs can be oriented such that each groove 30 can hold a portion of a rim of one other cup simultaneously. I.e. each cup which is held by the bottom portion can be directed to another direction. The grooves 30 can be oriented with four orientations which are symmetrically defined with respect to a central axis of the bottom portion 16. I.e., the four arcs of the grooves 30 are symmetrically disposed, and the four other cups are disposed in a corresponding orientation, such as cups 52*a*-52*d* shown in FIG. 5.

According to an example, the sidewall 12 includes a sloped portion 12*a* extending with an angle with respect to the bottom portion 16 and the rim 14 vertically extends with respect to the sloped portion 12. This way the radius of the bottom portion 16 of each cup is smaller than the radius of the rim 14 of the cup. The cups can thus be stacked one inside the other, i.e. the bottom of one cup can be fully disposed inside the opening 20 of another cup. This way, the cups in a storage position can be stacked up.

Figure 3A:
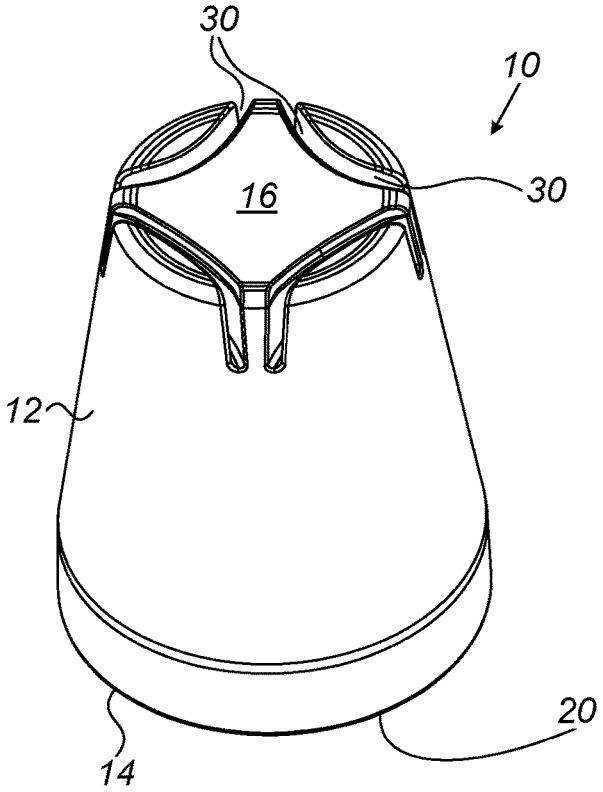
FIG. 3A is a bottom perspective view of the cup of FIG. 1.
Figure 3B:
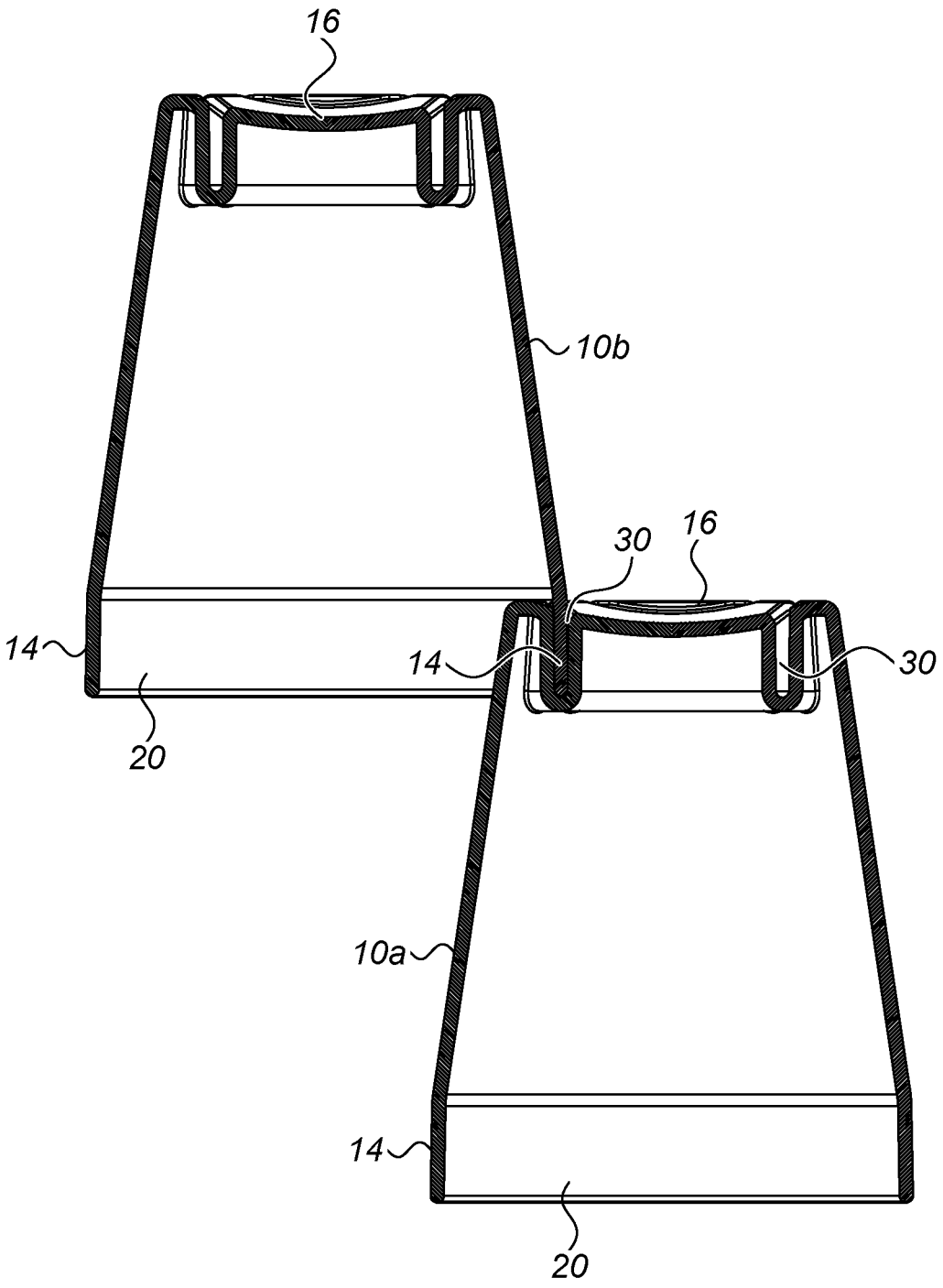
FIG. 3B is a sectional side view of two cups stacked on top of one another.

Reference is now made to FIG. 3B, the height of the rim 14, and the height of the groove 30 can be determined such that the rim 14 of a first cup 10*a* is securely held by the groove 30 if the second cup 10*b*. That is to say, the walls of the groove 30 of the first cup 10*a* engage the portion of the rim 14 of the second cup 10*b*, and exert counterforces to the forces acting on the second cup 10*b*. thus, in case the second cup 10*b* is held solely by one first cup 10*a*, the weight of the second cup 10*b* exerts downwardly forces on the second cup 10*b*, and consequently a torque is exerted on the walls of the groove 30 *f* the first cup 10*a*. thus, the height of the groove 30 and the rim is determined in accordance with the weight of the cup and the mechanical support required to securely hold the second cup 10*b*.

FIG. 4. is an example of a plurality of cups 42 stacked in an up-side-down position forming a shape of an up-side-down pyramid 40. The first cup 42*a* is disposed up-side-down allowing thereby four other cups 42*b* to be securely held by the grooves formed in the bottom portion 16 of the first cup 42*a*. This way, the first cup 42*a* forms a first layer A, and cups 42*b* form a second layer B. As explained herein above the grooves are configured such that the four cups 42*b* are held solely by the first cup 42*a*. Similarly, each one of the cups 42*b* holds four other cups 42*c* forming a third layer C of cups. The cups 42*c* which are disposed at the corners of the third layer C, are each held by one of the cups 42*b* of the second layer B. The cups that are however disposed between other cups, such as cup 45, is held by two cups 46*x* and 46*y* of the second layer. Since the grooves of all the cups are symmetrically orientated, one portion of the rim of cup 45 can be disposed inside one of the grooves of cup 46*x*, and another portion of the of the rim of cup 45 can be disposed inside one of the grooves of cup 46*y*.

Similarly, the pyramid 40 can include a forth layer D of cups 42*d*, each of which being held by at least one of the cups 42*c* of the third layer.

FIG. 5 is a side view of a plurality of cups 52 stacked in an up-side-down position forming a shape of a dog. As explained hereinabove, it is due to the mechanical support provided by the engagement of each grove of one cup with a portion of a rim of another cup, that the cups can be stacked in various shapes. The orientations of the grooves which is consistent to all of the cups allow stacking up cups in a unified form, the grooves of the cups of one layer are oriented in a substantially same direction as the grooves of cups a second layer.

Figure 6A:
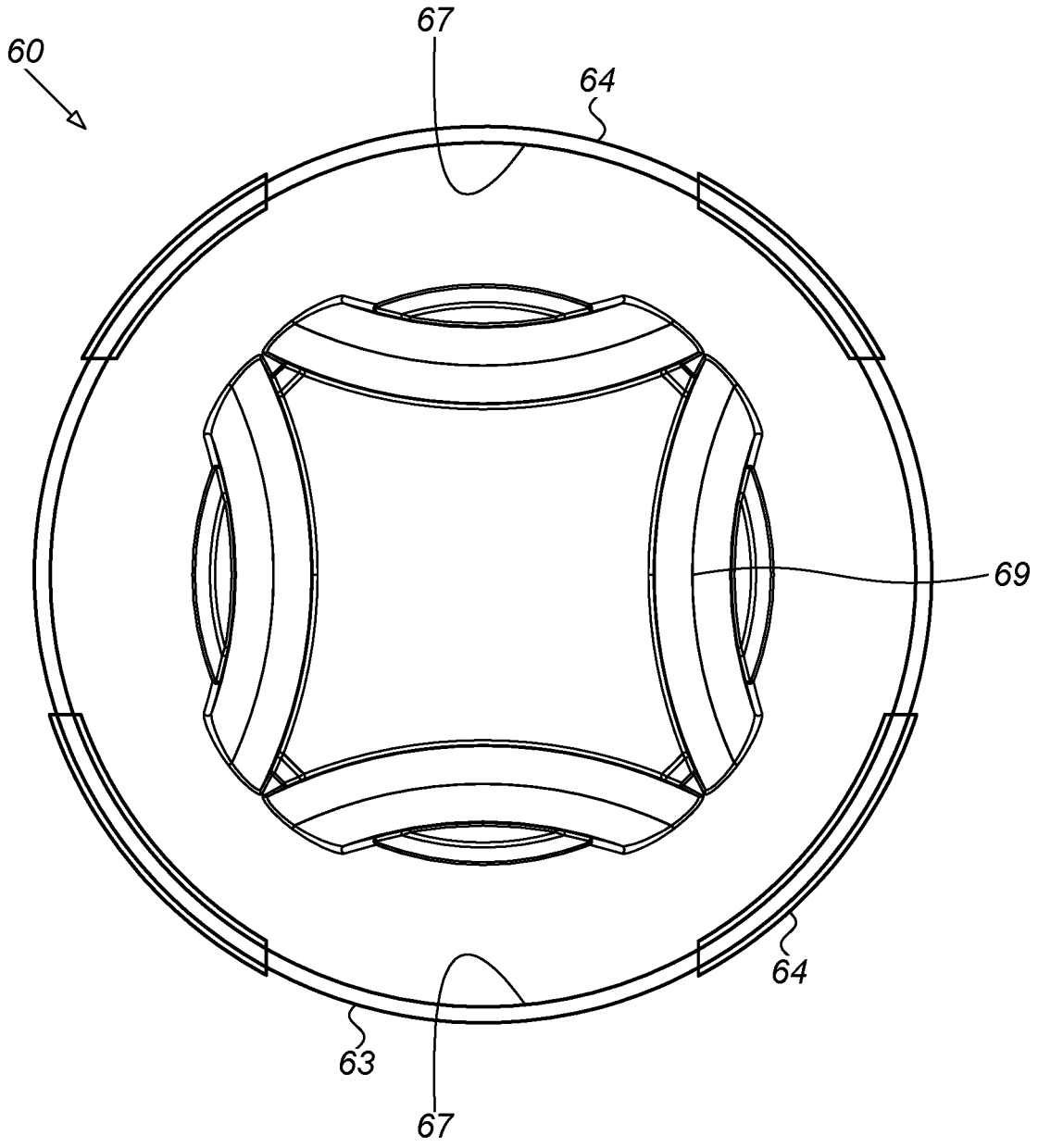
FIG. 6A is a top view of a cup according to another example of the presently disclosed subject matter.

Reference is now made to FIGS. 6A and 6B, according to an example the stacking cup 60 acan include at least one guide 63 defined on the rim 64 for facilitating insertion of the rim into a groove of another cup. The guide 63 can be configured to facilitate the positioning of the rim of a first cup inside a groove of a second such that the grooves of the first cups are orientated in the same direction as the grooves of the second cup.

According to an example, the rim 64 of the cup 60 includes portions having width larger than the width of the groove 69, such that these portions of the rim 64 cannot be inserted into the groove. The guides 63 according to this example, are in a form of depressions 67 defined in the rim 64 having a reduced width which is corresponding to the width of the groove. This way, the rim 64 of one cup can be inserted into the groove 69 of another cup only by insertion of one of the depressions 67 into the groove 69.

The grooves 69 can thus extends along an arc having predetermined orientations with respect to the sidewall of the cup, and the depressions 67 are defined along the rim 64 with corresponding orientations. This way, when a second cup is held by one of the grooves 69, the grooves of the second cup are oriented in same orientations as the grooves of the first cup.

FIG. 7 is a sectional view of two stacked cups 70*a* and 70*b* according to a further example of the presently disclosed subject matter. According to this example, each of the cups include a bottom portion 75 a sidewall 72, which includes a sloped portion 72*a* and a rim 74. The bottom portion 75 defines one or more the grooves 79 configured to securely hold the rim of other cups.

According to this example, the grooves 79 of a first cup 70*a* has a width which is larger than the thickness of the rim 74 of the second cup 70*b*. This way, the insertion of the rim 74 into the groove 79 is facilitated. In order to provide the second cup 70*b*, with the required mechanical support such that the second cup 70*b* can be held by the first cup 70*a*, the rim 74 includes a height which is smaller than the height of the groove 79. Thus, when the rim 74 of the second cup 70*b* is fully inserted into the grove 70 of the first cup 70*a*, a segment of the sloped portion 72*a* of the second cup 70*b*, is also disposed inside the groove 79. Due to the angle of the sloped portion 72*a*, the sidewall 72 abuts the wall of the groove 79 and is supported thereby. This way, in case the second cup 70*b* is held solely by the first cup 70*a*, the weight of the second cup exerts forces of the walls of the groove 79 of the first cup 70*a*, such that one wall of the groove 79 counter the forces exerted by the rim 74 of the second cup 70*b*, while the opposite wall of the groove 79 counter the forces exerted by the segment of the sloped portion 72*a*, and the second cup is securely held by the groove 79.

According to another aspect of the presently disclosed subject matter, stackable vessels similar to the cup described above, can be provided as a plant pot. The plant pot can include a side wall having a rim on a first end thereof defining an upper opening and a bottom portion defined on a second end of the side wall, forming thereby a vessel having the upper opening for disposing therein plants. The bottom portion can include at least one engaging element defined thereon and being configured to engage a portion of a rim of another plant pot, such that the rim can engage an engaging element of other plant pot and securely hold by the other plant pot.

The engaging portion can be a groove defined along a section of the bottom portion and being configured to allow engaging a rim of another pot such that the two pots are securely coupled to one another. The groove can be defined along a line extending inside the bottom portion between two points along the circumference of the bottom portion. Thus, a first pot can be held on top of a second pot by securing the groove defined on the bottom portion of the top pot to the rim of the bottom pot.

The line can be an arc having a radius corresponding to radius of the rim of the pot. The arc can be an arc of a circle having a central axis which is different than a central axis of the bottom portion. Accordingly, the groove of the top pot engages a first portion of the rim of the bottom pot, while a second portion of the rim of the bottom pot is disposed sidelong the bottom portion of the top pot.

Those skilled in the art to which the presently disclosed subject matter pertains will readily appreciate that numerous changes, variations, and modifications can be made without departing from the scope of the invention, mutatis mutandis.

The invention claimed is:

1. A stacking cup comprising:

a side wall having a rim on a first end thereof defining an upper opening, said rim vertically extends with respect to said side wall;

a bottom portion defined on a second end of said side wall such that said sidewall and said bottom portion define a vessel having said upper opening;

at least one engaging element defined on said bottom portion, said at least one engaging element includes a groove defined along a section of said bottom portion, said groove is configured to allow insertion of a portion of a rim of another cup such that said other cup is securely held by said groove;

wherein said rim includes at least one guide for facilitating insertion of said rim of one cup into a groove of another cup; and wherein width of said rim is larger than width of said groove, and wherein said at least one guide includes a depression defined as a section of said rim having a reduced width with respect to other sections of the rim, wherein said reduced width corresponds to the width of the groove such that insertion of a rim of said one cup into said groove of said another cup is carried out by inserting said depression into said groove.

2. The stacking cup according to claim 1 wherein said at least one engaging element includes four engaging elements each being configured to securely hold a portion of a rim of one other cup, such that said bottom portion securely holds four other cups simultaneously.

3. The stacking cup according to claim 1 wherein said groove is defined along a line extending inside said bottom portion between two points along the circumference of said bottom portion.

4. The stacking cup according to claim 3 wherein said line is an arc having a radius corresponding to radius of said rim of said other cup.

5. The stacking cup according to claim 4 wherein said arc is an arc of a circle having a central axis which is different than a central axis of the bottom portion, such that a first portion of the rim of the other cup is held inside the groove while a second portion of the rim of the other cup is disposed sidelong the bottom portion.

6. The stacking cup according to claim 5 wherein circumferential length of said first portion is smaller than circumferential length of said second portion.

7. The stacking cup according to claim 3 wherein said least one engaging element includes four engaging elements each having a groove extending along an arc each of which have an orientation with respect to one of the sides of said sidewall, thereby securing another cup to said bottom portion at four different orientations.

8. The stacking cup according to claim 7 wherein said four orientations are symmetrically defined with respect to a central axis of said bottom portion.

9. The stacking cup according to claim 1 wherein said sidewall includes a sloped portion extending with an angle with respect to said bottom portion and wherein said rim vertically extends with respect to said sloped portion.

10. The stacking cup according to claim 9 wherein depth of said groove is larger than height of said rim, such that when said rim is inserted inside a groove of another cup, a portion of said sidewall is disposed inside said groove and is supported by said groove such that said other cup vertically extends with respect to said bottom portion.

11. The stacking cup of claim 1 wherein said groove extends along an arc having an orientation with respect to one of the sides of said sidewall, and wherein said depression is disposed along said rim with a corresponding orientation, such that when said depression of said one cup is inserted into said groove of said other cup, said groove of said one cup is oriented in a same orientation as orientation of said groove of said other cup.

12. The stacking cup of claim 1, wherein said groove extends along an arc having an orientation with respect to one of the sides of said sidewall, and wherein said at least one guide is disposed on said rim such that when said rim of said one cup is inserted into said groove of said other cup, said groove of said one cup is oriented in a same orientation as orientation of said groove of said other cup.

13. A stacking game having at least one first cup and at least one second cup, each of said at least one first and second cups comprising:

a side wall having a rim on a first end thereof defining an upper opening; said rim vertically extends with respect to said side wall;

a bottom portion defined on a second end of said side wall such that said sidewall and said bottom portion define a vessel having said upper opening; at least one engaging element defined on said bottom portion, said at least one engaging element of said first cup includes a groove defined along a section of said bottom portion and being configured to allow insertion of a portion of a rim of said second cup such that said second cup is securely held by said groove;

wherein said rim includes at least one guide for facilitating insertion of said rim of said second cup into a groove of said first cup; and wherein width of said rim is larger than width of said groove, and wherein said at least one guide includes a depression defined as a section of said rim having a reduced width with respect to other sections of the rim, wherein said reduced width corresponds to the width of the groove such that insertion of a rim of said second cup into said groove of said first cup is carried out by inserting said depression into said groove.

14. The stacking game according to claim 13 wherein said at least one second cup includes four second cups and wherein said at least one engaging element includes four engaging elements each being configured to securely hold a portion of a rim of one of said second cups, such that said bottom portion securely holds said four second cups simultaneously.

15. The stacking game according to claim 14 wherein each one of said engaging elements includes a groove defined along a line extending inside said bottom portion between two points along the circumference of said bottom portion.

16. The stacking game according to claim 15 wherein said line is an arc having a radius corresponding to radius of said rim of said second cups.

17. The stacking game according to claim 16 wherein said arc is an arc of a circle having a central axis which is different than a central axis of the bottom portion, such that a first portion of the rim of one of the second cups is held inside the groove while a second portion of the rim of the one of the second cups is disposed sidelong the bottom portion.

* * * * *